US007915951B1

(12) United States Patent
Jurasek

(10) Patent No.: US 7,915,951 B1
(45) Date of Patent: Mar. 29, 2011

(54) LOCALLY CALIBRATED CURRENT SOURCE

(75) Inventor: Ryan Andrew Jurasek, S. Burlington, VT (US)

(73) Assignee: Nanya Technology Corp., Kueishan, Tao-Yuan Hsien (TW)

( * ) Notice: Subject to any disclaimer, the term of this patent is extended or adjusted under 35 U.S.C. 154(b) by 40 days.

(21) Appl. No.: 12/610,358

(22) Filed: Nov. 2, 2009

(51) Int. Cl.
*G05F 1/10* (2006.01)

(52) U.S. Cl. ..... 327/538

(58) Field of Classification Search ..... 327/534, 327/535, 537, 538, 543
See application file for complete search history.

(56) References Cited

U.S. PATENT DOCUMENTS 7,307,470 B2 * 12/2007 Hasegawa ..... 327/543
7,466,166 B2 * 12/2008 Date et al. ..... 327/108
7,514,989 B1 * 4/2009 Somerville et al. ..... 327/543
7,675,317 B2 * 3/2010 Perisetty ..... 326/38

* cited by examiner

*Primary Examiner* — Jeffrey S Zweizig
(74) *Attorney, Agent, or Firm* — Winston Hsu; Scott Margo

(57) ABSTRACT

A microchip that can calibrate a plurality of circuits on the microchip with a current reference includes: at least a first circuit disposed on the microchip; at least a first local bias generation circuit, for generating a bias current that is input to the first circuit; an external current reference, coupled to the first local bias generation circuit, for updating the bias current; and a calibration logic, coupled to the first local bias generation circuit, for enabling the external current reference to update the bias current according to a valid calibration signal.

8 Claims, 2 Drawing Sheets

LOCALLY CALIBRATED CURRENT SOURCE

BACKGROUND OF THE INVENTION

1. Field of the Invention

The present invention relates to a current source on a chip that can be calibrated on-chip to provide a current source that is PVT independent.

2. Description of the Prior Art

Microchips require PVT independent reference currents that can be input to various local circuits on the chip. In order to avoid the effects of noise, a reference current is routed to the chip over a long distance, and then rerouted to all circuits on the microchip. Each circuit requires a separate wire for this routing, which takes up space on the chip. It is therefore an object of the present invention to provide a circuit that reduces the number of wires required for providing a constant current reference to many circuits on a chip.

SUMMARY OF THE INVENTION

A microchip that can calibrate a plurality of circuits on the microchip with a current reference according to an exemplary embodiment of the present invention comprises: at least a first circuit disposed on the microchip; at least a first local bias generation circuit, for generating a bias current that is input to the first circuit; an external current reference, coupled to the first local bias generation circuit, for updating the bias current; and a calibration logic, coupled to the first local bias generation circuit, for enabling the external current reference to update the bias current according to a valid calibration signal.

These and other objectives of the present invention will no doubt become obvious to those of ordinary skill in the art after reading the following detailed description of the preferred embodiment that is illustrated in the various figures and drawings.

DETAILED DESCRIPTION

The present invention provides an architecture whereby current can be routed to local circuits on a chip utilizing fewer wires than prior art methods. By the use of additional circuitry that is within the microchip, local calibration can take place.

Figure 1:
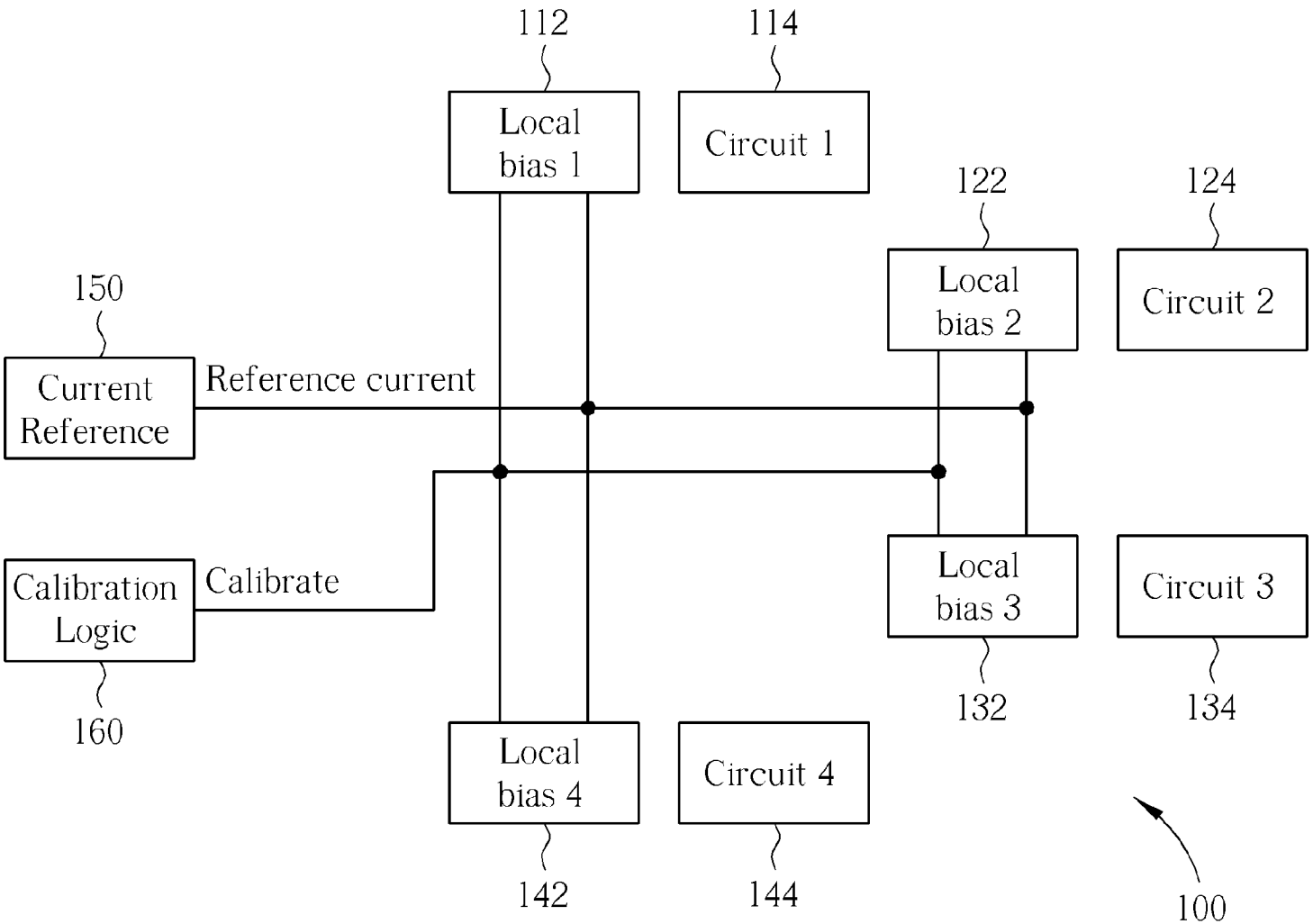
FIG. 1 is a diagram of a circuit that provides a constant current reference to a microchip that uses less wires than a prior art circuit.

Please refer to FIG. 1, which is a diagram of the proposed architecture 100. As can be seen from the diagram, the microchip 100 includes a plurality of local crude bias generation circuits 112, 122, 132, 142 that are placed close to corresponding circuits 114, 124, 134, 144 that require the current reference source. These local crude bias generation circuits 112, 122, 132, 142 serve to generate a crude bias that is insensitive to supply voltage, but can be process and temperature sensitive. This is because the bias current is constantly updated by a master current reference.

The master current reference 150, which is process, voltage and temperature (PVT) insensitive, is input to the microchip 100. This current reference is then routed over a single wire which is coupled to each of the local crude bias generation circuits 112, 122, 132, 142. The microchip 100 also comprises a calibration logic circuit 160 which is similarly routed over a single wire and coupled to each of the local crude bias generation circuits 112, 122, 132, 142.

The calibration logic 160 is only enabled when a particular circuit requires calibration. Each local circuit 114, 124, 134, 144 can have a specific enable signal. When the valid enable signal is received from the calibration logic 160, the crude bias generation circuit will calibrate its corresponding circuit.

Figure 2:
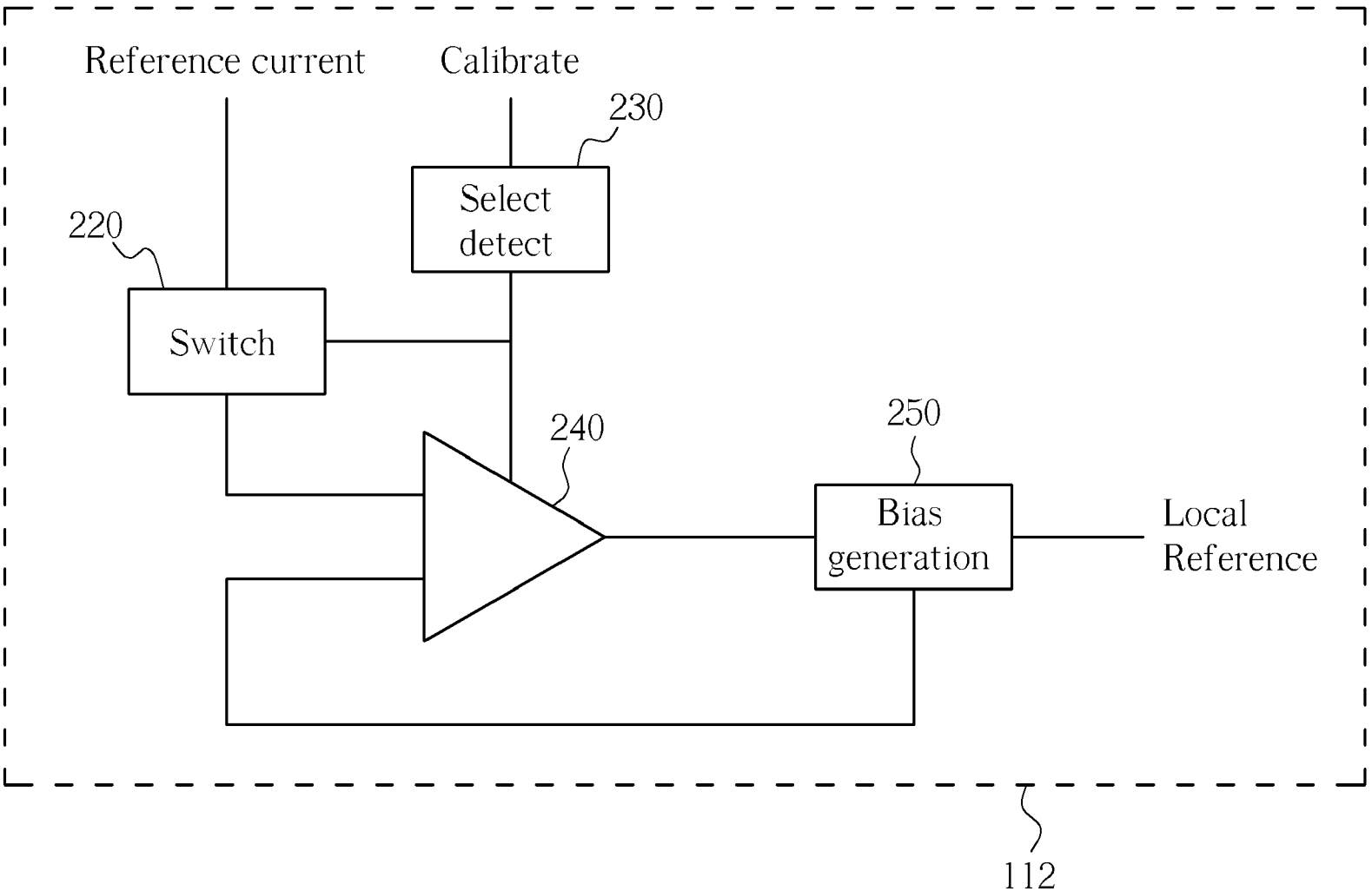
FIG. 2 is a diagram of the local crude bias generator shown in FIG. 1.

Please refer to FIG. 2, which is a diagram of the local crude bias generation circuit 112, shown in FIG. 1. Please note that this circuit is only shown as an example, and all other circuits have the same configuration. As can be seen in FIG. 2, the circuit 112 comprises a switch 220 and a select detection circuit 230, respectively coupled to the reference current and the calibration signal. These circuits are coupled to a comparator 240, which is coupled in turn with a bias generator 250.

When the calibration logic is a valid logic for the circuit 112, the switch 220 will be on, allowing the reference current to be input. The current reference is then compared with the locally generated current, which is fed back from the bias generation circuit 250, by the comparator 240. The comparator 240 will then generate a correction amount for updating the locally generated current, so that the output of the local crude bias generation circuit 112 equals the current reference that is supplied (i.e. the master current).

The locally generated current is insensitive to voltage only. As each locally generated current is constantly updated by a PVT insensitive reference, however, the current that is supplied to the local circuits 11, 124, 134, 144 will be PVT independent.

The means for determining when to update the current can occur at any time. In one embodiment, updates occur according to a certain period of time. In another embodiment, as the locally generated current is sensitive to temperature, each time there is a temperature change the calibration logic 160 will be enabled to allow current updates.

As the current reference is used to update locally generated currents, it only requires a single wire for coupling with the local crude bias generation circuits 112, 122, 132, 142. The current that is input to the local circuits 114, 124, 134, 144 is constantly updated by a PVT insensitive reference, so it does not need to be temperature and process insensitive. The use of the calibration logic circuit 160 for selectively enabling updates of the locally generated current allows the number of wires used in the microchip 100 to be fewer than those used in the prior art.

Those skilled in the art will readily observe that numerous modifications and alterations of the device and method may be made while retaining the teachings of the invention.

What is claimed is:

1. A microchip that can calibrate a plurality of circuits on the microchip with a current reference, comprising:

at least a first circuit disposed on the microchip;

at least a first local bias generation circuit, for generating a bias current that is input to the first circuit;

an external current reference, coupled to the first local bias generation circuit by means of a first wire, for updating the bias current; and a calibration logic, coupled to the first local bias generation circuit by means of a second wire, for enabling the external current reference to update the bias current according to a valid calibration signal.

2. The microchip of claim 1, further comprising:

a second circuit disposed on the microchip; and a second local bias generation circuit, coupled to the first local bias generation circuit by means of a third wire and a fourth wire, for generating a bias current that is input to the second circuit according to the external current reference;

wherein the first wire and the second wire are respectively coupled to a first node of the third wire and a first node of the fourth wire.

3. The microchip of claim 2, wherein the bias current of the first local bias generation circuit and the bias current of the second local bias generation circuit are updated according to different valid calibration signals.

4. The microchip of claim 2, wherein the bias current of the first local bias generation circuit and the bias current of the second local bias generation circuit are updated according to the same valid calibration signal.

5. The microchip of claim 2, further comprising:

a third circuit disposed on the microchip; and a third local bias generation circuit, coupled to the external current reference and the calibration logic, for generating a bias current that is input to the third circuit;

wherein the third local bias generation circuit updates the bias current according to the external current reference when a valid calibration signal is input to the third local bias generation circuit.

6. The microchip of claim 1, wherein the first local bias generation circuit comprises:

a switch, coupled to the external reference current;

a select detect circuit, coupled to the calibration logic and the switch, for opening the switch when a valid calibration signal is detected;

a comparator, coupled to the switch and the select detect circuit, for comparing the bias current with the external reference current and generating a value for updating the bias current; and a bias generation circuit, for generating the bias current according to the value generated by the comparator, and for feeding back the generated bias current to an input of the comparator.

7. The microchip of claim 1, wherein the valid calibration signal is generated periodically.

8. The microchip of claim 1, further comprising:

a thermal detector, for detecting an operating temperature of the microchip;

wherein the valid calibration signal is generated when the operating temperature of the microchip changes by a predetermined amount.

* * * * *